US005253392A

United States Patent [19]

Ripley

[11] Patent Number: 5,253,392

[45] Date of Patent: Oct. 19, 1993

[54] SYSTEM AND METHOD FOR PRODUCING A BLEACHED COTTON, NONWOVEN WEB

[76] Inventor: William G. Ripley, 4218 88th, Lubbock, Tex. 79452

[21] Appl. No.: 950,272

[22] Filed: Sep. 24, 1992

Related U.S. Application Data

[63] Continuation-in-part of Ser. No. 612,558, Nov. 13, 1990, Pat. No. 5,199,134.

[51] Int. Cl.[5] ..... D01G 21/00

[52] U.S. Cl. ..... 19/66 CC; 19/45.5; 19/105; 19/65 A

[58] Field of Search ..... 19/65 A, 65 R, 66 R, 19/66 CC, 80 R, 144, 145, 145.5, 145.7, 200, 201, 204, 205, 296, 302, 304, 297, 105, 0.27, 150, 151; 28/103, 104; 8/101

[56] References Cited

U.S. PATENT DOCUMENTS

| | | | |
|---|---|---|---|
| 3,493,452 | 2/1970 | Cole | 19/296 |
| 3,768,118 | 10/1973 | Ruffo et al. | 19/156.3 |
| 3,802,030 | 4/1974 | Acree | 19/66 CC |
| 4,718,152 | 1/1988 | Suzoki et al. | 28/104 |
| 4,944,070 | 7/1990 | Girard et al. | 19/66 R |
| 5,038,438 | 8/1991 | Gunter | 19/65 A |

*Primary Examiner*—Clifford D. Crowder
*Assistant Examiner*—Michael A. Neas
*Attorney, Agent, or Firm*—Cort Flint; Henry S. Jaudon

[57] ABSTRACT

A continuous textile processing system and method are disclosed for producing a nonwoven web containing bleached cotton fibers in a single line system which includes a supply of fibers such as a bale opening device, a plurality of fiber delivery lines transport the fibers through a fiber opening process where the fibers are individualized and opened. The opened fibers are collected and fed to a blending system and then to web forming apparatus which forms a stable web. The web is processed in a continuous flow bleaching unit and then through a drier unit. The dried web is slit into a plurality of web strips or slivers which are fed to carding machines. The fibers are reformed into a web which is hydroentangled and dried. The web is then rolled and redied for other processing. The final nonwoven web consisting of bleached cotton fibers may be made into highly purified and absorbent wipes, pads, and other articles for medical, industrial, or domestic use.

23 Claims, 1 Drawing Sheet

E
A
10
12
14
16
18
10'
19
10''
20
20a
20b
22
24
24a
26
26a
28
30
32
34
C
I
II
III
IV
V
W
W'
W''
36
38
40
42
44
46
48
D
5
6
7
8
56
60
62
64

SYSTEM AND METHOD FOR PRODUCING A BLEACHED COTTON, NONWOVEN WEB

This is a continuation in part of co-pending application Ser. No. 612,558 filed on Nov. 13, 1990 now U.S. Pat. No. 5,199,134.

BACKGROUND OF THE INVENTION

The invention relates to a continuous, fully integrated system and method for producing nonwoven webs consisting of bleached cotton fibers.

Bleached cotton fibers have been used in many nonwoven fabric applications for cleanliness and absorbency such as wipes, pre-moistened towelettes, absorbent pads, etc. The purified, absorbent fibers are particularly advantageous in hospital and medical applications such as disposable sheets, blankets, gowns, and bandages, and, particularly, because of their biodegradability. Typically the bleached cotton fibers are made into a nonwoven web and then fabricated for the particular end use.

The typical process has included many separated processing steps. Typically, raw cotton fibers are bleached at a remote bleachery using a large vat. The bleached fibers are dried and pressed into bales. The bales of bleached cotton fibers are then transported to a textile mill at another location where they are processed further by a nonwoven carding system into nonwoven webs in a conventional manner. Bleaching processes have not been a part of nonwoven textile processing lines. As a result, the textile process has been fairly inefficient incurring transportation costs, and inefficiency through piecemeal processing.

Various textile process lines for woven and nonwoven fabrics are known and have been proposed in the past. Various processes and systems are known for opening, cleaning, and blending fibers, for example, U.S. Pat. No. 2,718,671. Various processes and systems for opening fiber bales, and opening and cleaning the fiber before being carded into a web for woven or nonwoven applications are known, for example, as shown in U.S. Pat. No. 4,535,511.

It is known to make webs formed from synthetic fibers more integral by hydroentanglement techniques. Various hydroentanglement techniques and apparatus for producing integral webs having various patterns are shown in U.S. Pat. Nos. 3,494,821; 3,486,168; 3,485,706; 3,508,308; and 3,493,462.

The increased demand for the bleached cotton fiber, for both woven and nonwoven products has rendered the prior bleaching and textile processes unsatisfactory because it is now necessary to use a lower grade of cotton.

Accordingly, an important object of the present invention is to provide a system and method for producing bleached cotton, nonwoven webs in a single processing line under one roof.

Another object of the invention is to provide a continuous bleached web producing process capable of converting low grade, dirty, short stable cotton fibers.

Another important object of the invention is to provide an efficient textile process system and method which begins with the opening of raw cotton fibers from bales and ends with the production of nonwoven webs consisting of bleached cotton fibers in a single process.

Another object of the invention is to provide a textile processing system and method wherein raw cotton fibers may be processed and bleached and the bleached fibers may be subjected to further processing and production of a nonwoven web and prepared for further textile processing.

Another object of the invention is to provide a cotton processing system capable of producing cleaned and bleached cotton at an extremely high yield.

Another object of the invention is to provide a cotton processing system which reduces the cost per pound of processing clean and bleached cotton.

Another object of the invention is to produce surgical grade cleaned and bleached cotton at a rate of at least three thousand pounds per hour.

Another object of the invention is to provide a system which fully cleans and blends low grade cotton for the formation of bleached cotton webs.

SUMMARY OF THE INVENTION

A continuous fiber processing system for producing a bleached and blended cotton fiber web beginning with bale opening means for opening bales of cotton fibers and delivering the fibers to a plurality of fiber feed lines each of which includes a first fiber opening means for individualizing and cleaning the fibers to produce cleaned opened fibers. From the opening means the fibers move to first blender means which includes a common conveyor for collecting the opened and cleaned fibers from the plurality of fiber delivery lines and conveys them to a common point. From the common point, the opened fibers are fed to a second fiber blending means. The second fiber blending means further mixes the cleaned and opened fibers to produce cleaned and twice blended fibers. A distributor means receives these twice blended fibers and delivers them to feeder means. The distributer means also acts to further blend the fibers.

Web forming means now receive the cleaned and twice blended fibers from the feeder means and act to form a stable fiber web. The web is delivered to a continuous flow bleaching system which bleaches the fibers forming the web producing a web of bleached cotton fibers. From the bleaching system, the web is fed into a dryer system for drying. From the dryer system the now dried bleached web goes to a slitter which slits same into a plurality of web strips or slivers. The slivers are fed to a plurality of carding machines which further blend and clean the fibers and also forms them into a loose web. The loose webs are delivered to a common conveyor means in stacked overlaying fashion forming a stacked web. The common conveyor delivers the stacked bleached web to a second web stabilizing means in the form of a hydroentangling system which produces a stable web of entangled fibers. The stable web is passed to a dryer mechanism and from there to roll forming means wherein it is a rolled web for use in further fiber processes.

To obtain additional blending web cross-lapping means may be arranged to receive the non-woven webs from the carding machines. This arrangement forms a cross-lapped web having a plurality of web layers.

The first web forming means preferably consist of hydroentangling means which produce a stable web prior to bleaching by entangling and interlocking the fibers forming the web.

The second fiber blending system comprises a plurality of fiber blending units, and a switch box which selectively delivers the opened fibers from the common point to the blending units.

The first dryer system comprises a foam dryer for receiving and treating the bleached web from the fiber bleaching means and a web drying oven for receiving the web from the foam drying means. Also, there may be included apparatus for applying an additive to the bleached cotton fibers before they are dried as they exit the fiber bleaching means. Additionally, means for dying the bleached and hydroentangled web a desired color may be provided.

A continuous textile processing system for producing a non-woven web of bleached cotton fibers beginning with a supply of cotton fibers and fiber opening means for individualizing, cleaning, and blending these fibers. A first hydrogenating system forms a thin web from the cleaned and opened fibers and delivers this web to a continuous flow bleaching means in a continuous flow the fibers are transformed into a bleached web. A dryer system drys the bleached web and delivers it to slitter which is operative to slit the bleached and dried web into a plurality of slivers. Feeding means deliver the slivers of fibers to multiple carding machines. The carding machines card the bleached fibers, each producing a bleached non-woven web. Cross capping apparatus receive the carded webs to form stacked cross lapped webs. These webs are delivered to conveying means where they are stacked one on the other.

Second hydroentangling means received the stacked web of fibers and form a stable multi-layered nonwoven web of bleached fibers in which the bleached cotton fibers are interlocked in an integral web structure.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 2:
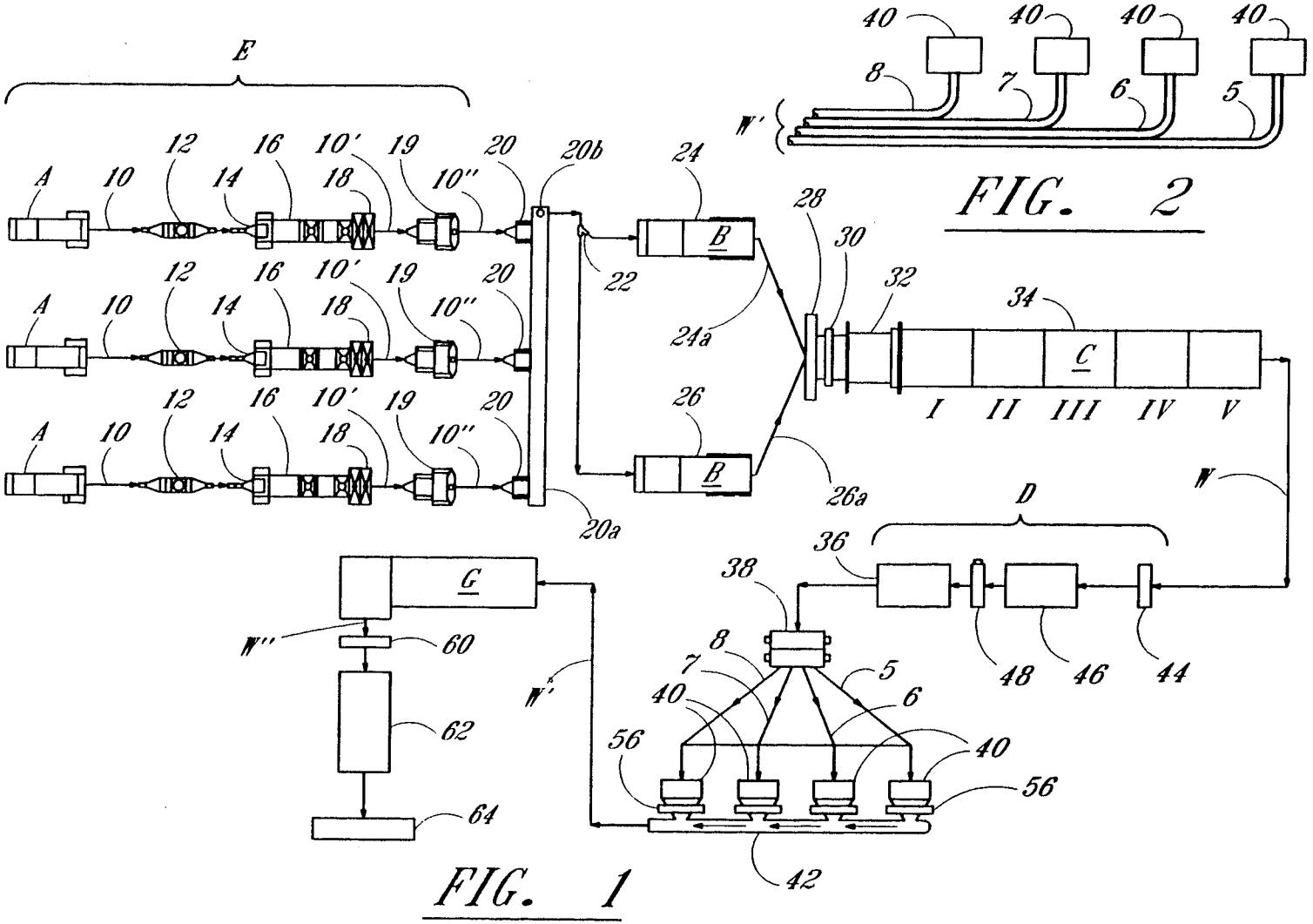
FIG. 1 is a schematic view illustrating a textile processing system and method for producing bleached cotton, nonwoven webs in a single and continuous processing line.
FIG. 2 is a schematic view illustrating the carded web stacking arrangement.

Referring now in more detail to the drawings, a system and method for producing a nonwoven web of cleaned and bleached cotton fibers will be described. The system begins with at least three fiber delivery lines 10. Each line 10 is connected with a bale opener A which may be any suitable and known type such as a HF6012 hopper feeder manufactured by Hollingsworth, Inc. of Greenville, South Carolina. Since fiber delivery lines 10 are identical, only one such line will be described for an understanding of the invention. Fibers from bale opener A are pneumatically transported to an air/fiber separator 12 which provides some initial fiber-/air separation and dust removal. The fibers then go into a condenser feeding unit 14, which cleans and removes dust and begins the process of opening and further individualizing the fibers. Any suitable condenser feeding unit may be used such as a KD condenser manufactured by Hollingsworth, Inc. Fibers are conveyed from condenser 14 in such a manner as to drop down into a first fiber opening means in the form of a conventional incline cleaner 16 which has a series of rolls and grids (not shown) which clean the trash out of the fiber. As the fiber passes through inclined cleaner 16, it also passes through a micro dust suction unit 18 which is disposed on top of incline cleaner 16 and acts to remove fiber from the incline cleaner through suction Micro dust unit 18 acts also as a doffer which removes micro dust in the transport air. Next, the fibers are drawn into condenser cleaning units 19 through ducts 10'. Condenser units 19 typically include a materials handling fan and a condenser to transport fiber out of incline cleaner unit 16. The arrangement thus far described comprises precleaning section E. The fibers are then transported from section E to condenser feeding unit 20 where the fibers arrive via pneumatic fiber delivery lines 10" to the condenser feeding units 20. Condenser feeding units 20 deposit the fiber onto a common, mechanical conveyor **20*a*** which acts as a blender because the fibers are overlayed.

At an end **20*b* of the conveyor, the fibers go to a switch box 22 which divides the fibers between the cross blenders or it may act to switch the fibers back and forth in a selected sequence between plural fiber blending means B which includes at least two cross blenders 24,26. The number of blenders B is determined by the volume of fibers being fed. Cross blenders 24, 26 may be any suitable fiber blenders such as LCB lay down cross blenders manufactured by Hollingsworth, Inc. The cross blenders blend the fibers while providing some fiber opening, and act as a reserve to feed bleach feeding lines 24*a*, 26*a*. The fibers coming out of the bleach feeding lines 24*a*, 26*a* are conveyed to over flow distributor 28 which acts to equalize the fiber flow and to deliver a constant uniform fiber flow to chute feeder 30. Chute feeder 30 may be of any suitable design such as that disclosed in U.S. Pat. No. 4,657,444. The fibers pass into chute feeder 30 at its upper end and are condensed into a uniform fiber mat by means of air and mechanical movements. A fiber web W is delivered from chute feeder 30 to hydroentangling unit 32. Hydroentangling unit 32 acts to entangle and interlock the fibers of web W together to form a stable web of highly entangled fibers capable of retaining its integrity as it passes through bleaching unit C. Plural blenders are used because the bleaching unit has a capacity of at least 4000 pounds per hour, and each blender has a capacity of about 2500 pounds per hour. Hydroentangling unit 32 may act on the top, the bottom, or both the top and bottom of each web W. Hydroentangling unit 32 has a capacity in excess of 4000 pounds per hour, thereby allowing the plural cross blenders B and bleaching unit C to operate at or near capacity. Change box 22 switches the fibers between lines 24*a*, 26*a***.

The web W moves through the bleaching unit via a plurality of bleaching chambers I, II, III, IV, and V via a plurality of rolls (not shown) and is immersed in various bleaching agents. The bleaching agents in the various chambers may be one or a combination of alkali impregnation, alkali steam reaction, alkali reuse, bleach impugn, bleach steam, or bleach venue. A suitable bleaching unit C is a continuous flow bleaching unit manufactured by Greenville Machinery of Greenville, South Carolina. The bleaching unit bleaches the fibers as they continuously flow through the bleaching unit in web form. A bleached fiber web W leaves bleaching unit C and passes into dryer system D. Dryer system D may include foam dryer 44 which applies a flame or mildew retardant to the fibers while still wet. The web may then pass to dryer 46 which can be a conventional gas fired textile oven operating at necessary speed and temperature to accommodate 4000 pounds per hour of fiber web. Dryer 46 may dry completely web W, in which case the web passes directly to slitter 38. Optionally, web W may be partially dried and passed to foam dryer 48 which also dyes the web a solid color. From dryer 48, web W passes into a second gas dryer 36 where drying is completed. Dried web W passes now to slitter 38 which slits the web into a plurality of web strips or slivers 5, 6, 7, 8. Slivers or web strips 5, 6, 7, 8 are each delivered to a carding machine 40 by delivery lines. There are shown four cards 40, however, the number may be increased or decreased depending upon the fiber pounds per hour delivered from slitter 38. Also, the number of slitters 38 may be increased if necessary. Referring now also to FIG. 2, each card 40 delivers a fiber web to mechanical conveyor 42 where the webs are lapped or stacked so as to again further blend the bleached fibers. The carded webs formed from web strips 5, 6, 7, 8 are now formed into bleached web and stacked W'. It is noted that the carding process performed by carding machine 40 removes trash, micro dust, and fibers which are too short. Cards 40 perform the final cleaning operation for the fibers prior to their being delivered for further product processing. The carded webs may be cross lapped and stacked by conventional cross lapping machines 56 prior to being lapped on conveyor 42. The bleached cross lapped cotton web W', is then fed to a hydroentanglement unit G which intermingles and interlocks the fibers together in an integral web W" of bleached cotton fibers. After drying by dryer 62, web W" is in condition to be handled for further applications or to be fabricated into various end products. A suitable hydroentanglement unit is manufactured by Honeycomb Systems of Maine. As web W', enters the hydroentanglement unit, it encounters a series of very fine water jet units that pierce the carded web and cause the fibers to be intermingled and interlocked. This action holds the web together. Hydroentanglement is a rather unique process which provides softness and the drapeablility to the web, and a generally lint free web. The finished product is dirt, dust, and lint free, and therefore, can be used in a lot of advantageous applications, such as with instruments or electronics, in hospitals, and other non-woven markets. Alternatively, web W" may optionally be conveyed through a foam dyer 60 which dyes the web a solid color, and then to a dryer 62, after which the web may be taken up on a roller 64 for transportation and further product processing.

While a preferred embodiment of the invention has been described using specific terms, such description is for illustrative purposes only, and it is to be understood that changes and variations may be made without departing from the spirit or scope of the following claims.

What is claimed is:

1. A continuous fiber processing system for producing a bleached and blended cotton fibers comprising:

bale opening means for opening bales of cotton fibers;

a plurality of fiber feed lines receiving fibers from said bale opening means;

each of said fiber feed lines including a first fiber opening means for individualizing and cleaning said fibers to produce cleaned opened fibers; and first blender means comprising a common conveyor for collecting said opened and cleaned fibers from said plurality of fiber delivery lines and conveying said opened and cleaned fibers to a common point so that said opened fibers may be fed to second fiber blending means;

said second fiber blending means for further mixing said cleaned and opened fibers to produce cleaned and multi-blended fibers;

distributor means receiving said twice blended fibers and delivering said blended fibers to feeder means;

said distributer means acting to further blend said fibers;

web forming means receiving said cleaned and twice blended fibers from said feeder means and forming a stable fiber web;

continuous flow bleaching means for receiving said web of cleaned and multi-blended fibers and producing a web of bleached cotton fibers;

a first dryer system for drying said web of bleached fibers;

slitter means receiving said bleached and dried web and slitting same into a plurality of slivers;

additional blending means including carding machines receiving said slivers of bleached fibers from said web slitting means and producing a plurality of carded webs;

common conveyor means receiving said carded webs of bleached fibers in stacked overlaying fashion, said common conveyor delivering said stacked bleached web to web stabilizing means;

said web stabilizing means acting to produce a stable web of bleached and entangled fibers;

a second dryer system receiving and drying said stabilized bleached web; and roll forming means receiving said dried, bleached web and forming a rolled web for use in further fiber processes.

2. The system of claim 1 including:

a chute feed receiving said multi-blended fibers from said distributer means and feeding same to said web forming means.

3. The system of claim 1 wherein said additional blending means includes web cross-lapping means receiving said carded webs from said carding machines and still further blending said fibers by forming at least a cross-lapped web having a plurality of web layers.

4. The system of claim 1 wherein said web forming means includes hydroentangling means for receiving said fibers and entangling and interlocking said fibers together to produce an integral web of bleached multi-blended cotton fibers.

5. The system of claim 1 wherein said web stabilizing means includes a hydroentangling means for receiving said carded web, said hydroentangling means acting to entangle and interlock said fibers of said web together to provide a stable web of bleached cotton fibers.

6. The system of claim 1 wherein said second fiber blending means comprises a plurality of fiber blending units, and a switch box for selectively delivering said opened fibers from said common conveyor selectively to said fiber blending units.

7. The system of claim 1 wherein said first dryer system includes a foam drying means for receiving and treating said bleached web from said fiber bleaching means and a web drying oven for receiving said bleached and treated web from said foam drying means.

8. The system of claim 1 wherein said first dryer system comprises:

at least one foam dryer unit and at least one drying oven unit, said units being arranged in sequence.

9. The system of claim 1 including means for applying an additive to said bleached cotton fibers while they are wet upon exiting said fiber bleaching means.

10. The system of claim 1 wherein said second dryer system includes means for dying said bleached, carded and hydroentangled web a desired color.

11. A continuous textile processing system for producing a non-woven web of bleached cotton fibers at a rate of at least three thousand pounds per hour comprising:

a supply of cotton fibers;

means receiving said fibers and delivering them to first web forming means;

said first web forming means producing a thin web from said fibers;

continuous flow bleaching means receiving said thin web for bleaching said fibers in a continuous flow and producing a bleached web;

a first dryer system for drying said bleached web of fibers;

slitter means, receiving said dried web from said first dryer system, are operative to slit said bleached and dried web into a plurality of web strips or slivers;

sliver feeding means for feeding said slivers of bleached fibers to a plurality of carding machines; and said carding machines carding said slivers of bleached fibers to produce a plurality of carded, bleached non-woven webs;

stacking means for stacking said carded webs to form a multi-layered web.

12. The system of claim 11 wherein said first web forming means are hydroentangling means.

13. The system of claim 11 including:

hydroentangling means for forming a hydroentangled web from said stacked multi-layered web in which said bleached cotton fibers are interlocked to form an stable web structure.

14. The system of claim 11 wherein said blending means comprise a plurality of fiber blending units, and a switch box operative to selectively delivering said opened fibers from a common point to either of said fiber blending units for further blending.

15. The system of claim 11 including cross lapping means receiving and cross lapping said carded webs of bleached fibers, said cross lapping means delivering said carded and cross lapped webs to conveying means where said webs are stacked one on the other forming a multi-layered web.

16. The system of claim 11 where said system is capable of processing cleaned and bleached cotton fibers at a rate of at least six thousand pounds per hour.

17. A continuous textile process for producing a non-woven web of bleached cotton fibers comprising:

supplying cotton fibers at a rate of at least three thousand pounds per hour;

opening said fibers from said fiber supply;

feeding said fibers in a plurality of fiber delivery lines:

cleaning said fibers in said plurality of delivery lines;

blending said fibers by collecting said fibers from said plurality of fiber delivery lines at a common point;

forming a thin stable web of said blended and opened fibers;

subjecting said thin web to a bleaching process for producing a bleached web and fibers;

drying said bleached web and fibers;

subjecting said fibers in said bleached web to a slitting process in which said web of bleached fibers is separated into a plurality of web strips of bleached fibers; and feeding said web strips of bleached fibers to carding machines, carding said web strips for further blending of said bleached cotton fibers into carded webs.

18. The process of claim 17 comprising forming said thin stable web of cotton fibers by subjecting said fibers to a first hydroentangling process for interlocking said fibers together into a hydroentangled, stable web structure.

19. The process of claim 18 including; blending said fibers and feeding said blended fibers from condenser means to cleaning, blending and distributing means where the fibers are further cleaned, further blended and distributed for further processing.

20. The process of claim 17 including;

cross lapping said carded webs so as to further blend said fibers;

forming said cross lapped webs into a single multi-layered web;

delivering said multi-layered web to a hydroentangling means to form a stable web of entangled fibers.

21. The process of claim 20 including; passing said hydroentangled web through a plurality of drying stations to dry said web and rolling said dried web into a roll.

22. The process of claim 17 including supplying cotton fibers at a rate of substantially six thousand pounds per hour.

23. The process of claim 17 including forming a single web from said plurality of carded webs and delivering said single web to a hydroentangling means to form a stable web of entangled fibers.

* * * * *